US008886093B2

(12) United States Patent
Hasebe

(10) Patent No.: US 8,886,093 B2
(45) Date of Patent: Nov. 11, 2014

(54) IMAGE FORMING APPARATUS, TONER SUPPLY MECHANISM, AND METHOD OF MOUNTING AND DISMOUNTING A TONER CARTRIDGE

(75) Inventor: Yoshifumi Hasebe, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 340 days.

(21) Appl. No.: 13/430,059

(22) Filed: Mar. 26, 2012

(65) Prior Publication Data

US 2012/0257912 A1 Oct. 11, 2012

Related U.S. Application Data

(60) Provisional application No. 61/472,170, filed on Apr. 5, 2011.

(51) Int. Cl.
*G03G 15/08* (2006.01)
*G03G 21/16* (2006.01)

(52) U.S. Cl.
CPC ..... *G03G 21/1676* (2013.01); *G03G 21/1642* (2013.01); *G03G 15/0886* (2013.01)
USPC ..... 399/258; 399/260

(58) Field of Classification Search
USPC ..... 399/258, 260, 262
See application file for complete search history.

(56) References Cited

U.S. PATENT DOCUMENTS 7,574,163 B2 * 8/2009 Sato ..... 399/260
7,747,198 B2 * 6/2010 Nakagami ..... 399/260

* cited by examiner

*Primary Examiner* — William J Royer
(74) *Attorney, Agent, or Firm* — Patterson & Sheridan LLP

(57) ABSTRACT

An image forming apparatus includes a toner cartridge, a toner supply unit, and a developing device. The toner cartridge includes a toner discharge port configured to discharge stored toner, and a shutter configured to open and close the toner discharge port. The toner supply unit includes an engagement unit configured to engage with the shutter of the toner cartridge, a toner supply port configured to communicate with the toner discharge port and to receive the toner supplied from the toner discharge port when the shutter is open, an opening member configured to open the shutter and an elastic member configured to cause the opening member to move following the shutter by being in contact with the shutter until at least the engagement between the engagement unit and the shutter is released during dismounting of the toner cartridge from the image forming apparatus.

20 Claims, 7 Drawing Sheets

IMAGE FORMING APPARATUS, TONER SUPPLY MECHANISM, AND METHOD OF MOUNTING AND DISMOUNTING A TONER CARTRIDGE

CROSS-REFERENCE TO RELATED APPLICATIONS

This application is based upon and claims the benefit of priority from Provisional U.S. Application No. 61/472,170, filed on 5 Apr. 2011, the entire contents of which are incorporated herein by reference.

FIELD

Embodiments described herein relate generally to an image forming apparatus, a toner supply mechanism, and a method of mounting and dismounting a toner cartridge.

BACKGROUND

In an image forming apparatus in the related art in which toner is supplied by mounting a toner cartridge to a developing device, a shutter which is provided at a toner discharge port is opened by being in contact with a member in the vicinity of a toner supply port of the image forming apparatus when inserting the toner cartridge, and is fixed by a hook being locked. In addition, there is a mechanism in which the shutter is closed by releasing the hook which locks the shutter, when dismounting the toner cartridge. In such a mechanism, a margin is provided in the dimensions, since it is necessary to reliably lock the shutter with a hook for closing the shutter when inserting the toner cartridge. For this reason, the shutter has a structure in which the shutter stops after slightly passing through the position at which the hook locks the shutter.

However, the margin generates a gap between the shutter in the toner discharge port of the toner cartridge and the member in the vicinity of the toner supply port of the image forming apparatus which come into contact with each other when inserting the toner cartridge, when the toner cartridge is taken out. As a result, the toner discharge port of the toner cartridge passes the gap while the shutter is closing, accordingly, the toner leaks.

DETAILED DESCRIPTION

The image forming apparatus according to the embodiment includes a toner cartridge, a toner supply unit, and a developing device. The toner cartridge includes a toner discharge port configured to discharge stored toner, and a shutter configured to open and close the toner discharge port. The toner supply unit includes an engagement unit configured to engage with the shutter of the toner cartridge, a toner supply port configured to communicate with the toner discharge port and to receive the toner supplied from the toner discharge port when the shutter is open, an opening member configured to open the shutter and an elastic member configured to cause the opening member to move following the shutter by being in contact with the shutter until at least the engagement between the engagement unit and shutter is released during dismounting of the toner cartridge from the apparatus. The developing device develops an electrostatic latent image which is formed on an image carrier using the toner which is supplied to a cartridge box.

Hereinafter, embodiments will be described.

<First Embodiment>

Figure 1:
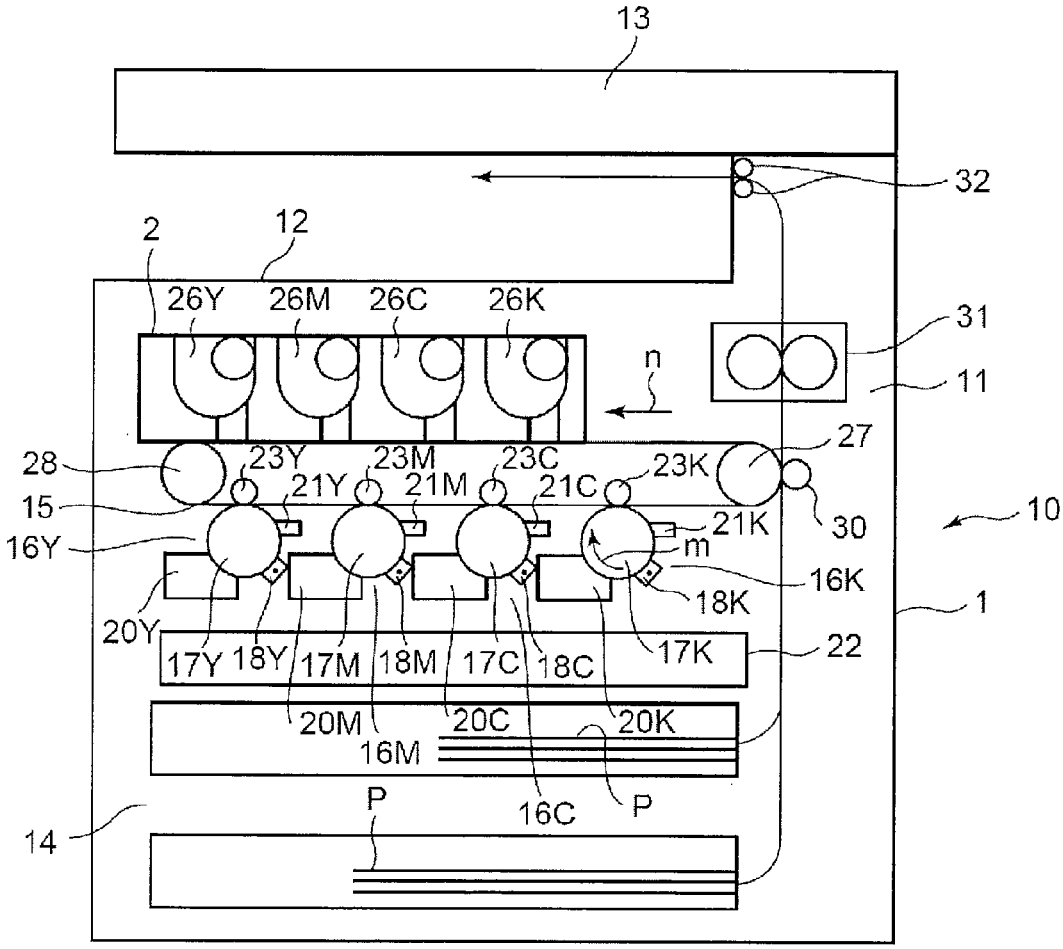
FIG. 1 is a schematic configuration diagram which shows an MFP according to the first embodiment.

FIG. 1 shows a color MFP (Multi-Functional Peripheral) 10 as an image forming apparatus according to the first embodiment. The MFP 10 includes, for example, a printer unit 11 which forms an image, a paper discharge unit 12 which receives a sheet P which is discharged from the printer unit 11, a scanner unit 13 which reads out an image, and a paper feed unit 14 which feeds paper P.

The printer unit 11 includes a set of four image forming stations 16Y, 16M, 16C, and 16K of Y (yellow), M (magenta), C (cyan), and K (black) which are arranged in parallel along the lower side of an intermediate transfer belt 15. Each of the image forming stations 16Y, 16M, 16C, and 16K includes photoconductive drums as image carriers 17Y, 17M, 17C, and 17K, respectively.

Each of the image forming stations 16Y, 16M, 16C, and 16K includes chargers 18Y, 18M, 18C, and 18K, developing devices 20Y, 20M, 20C, and 20K as developing units, and photoconductor cleaners 21Y, 21M, 21C, and 21K at the periphery of the photoconductive drums 17Y, 17M, 17C, and 17K which rotate in the arrow m direction.

Primary transfer rollers 23Y, 23M, 23C, and 23K are arranged at positions facing the photoconductive drums 17Y, 17M, 17C, and 17K of the intermediate transfer belt 15. Each of the primary transfer rollers 23Y, 23M, 23C, and 23K primarily transfers a toner image which is formed on each of the photoconductive drums 17Y, 17M, 17C, and 17K to the intermediate transfer belt 15. Each of the photoconductor cleaners 21Y, 21M, 21C, and 21K removes and collects residual toner on the photoconductive drums 17Y, 17M, 17C, and 17K after the primary transfer.

A laser exposure device 22 irradiates the photoconductive drums 17Y, 17M, 17C, and 17K with respective exposure light corresponding to each color, while the photoconductive drums 17Y, 17M, 17C, and 17K reach the developing devices 20Y, 20M, 20C, and 20K from the chargers 18Y, 18M, 18C, and 18K at the periphery thereof. An electrostatic latent image is formed on each of the photoconductive drums 17Y, 17M, 17C, and 17K by the irradiation of the respective exposure light from the laser exposure device 22.

Each of the developing devices 20Y, 20M, 20C, and 20K supplies the toner to the electrostatic latent image on the photoconductive drums 17Y, 17M, 17C, and 17K using a two-component developer which is formed of toner and carrier, and visualizes the electrostatic latent image.

Each of the developing devices 20Y, 20M, 20C, and 20K performs developing using the two-component developer which is formed of the toner of Y (yellow), M (magenta), C (cyan), and K (black), and the carrier.

A housing 1 of the MFP 10 as a main body includes a cartridge box 2 as a toner supply unit to or from which toner cartridges 26Y, 26M, 26C, and 26K are mounted or dismounted on the upper part of the developing devices 20Y, 20M, 20C, and 20K. Each of the toner cartridges 26Y, 26M, 26C, and 26K which is mounted to the cartridge box 2 respectively receives the toner of Y (yellow), M (magenta), C (cyan), and K (black). That is, a toner supply mechanism of the image forming apparatus is configured by mounting the toner cartridges 26Y, 26M, 26C, and 26K, respectively, in the cartridge box 2 as the toner supply unit. When the toner concentration of each developing device 20Y, 20M, 20C, and 20K is reduced, each of the toner cartridges 26Y, 26M, 26C, and 26K supplies the required amount of toner to each of the developing devices 20Y, 20M, 20C, and 20K.

The intermediate transfer belt 15 straddles a back-up roller 27 and a driven roller 28, and is rotated in the arrow n direction. A secondary transfer roller 30 faces a secondary transfer position of the intermediate transfer belt 15 which is supported by the back-up roller 27, A predetermined transfer bias is applied between the back-up roller 27 and the secondary transfer roller 30. The toner images on the intermediate transfer belt 15 are subject to the secondary transfer, collectively, on the sheet P which passes between the intermediate transfer belt 15 and the secondary transfer roller 30.

The printer unit 11 includes a fixing device 31 and paper discharge rollers 32 on the downstream side of the secondary transfer roller 30 along the transport direction of the sheet P. The fixing device 31 fixes the toner image which is transferred to the sheet by P the secondary transfer roller 30 to the sheet P.

The paper discharge rollers 32 discharge the sheet P with the fixed toner image to the paper discharge unit 12.

Figure 2:
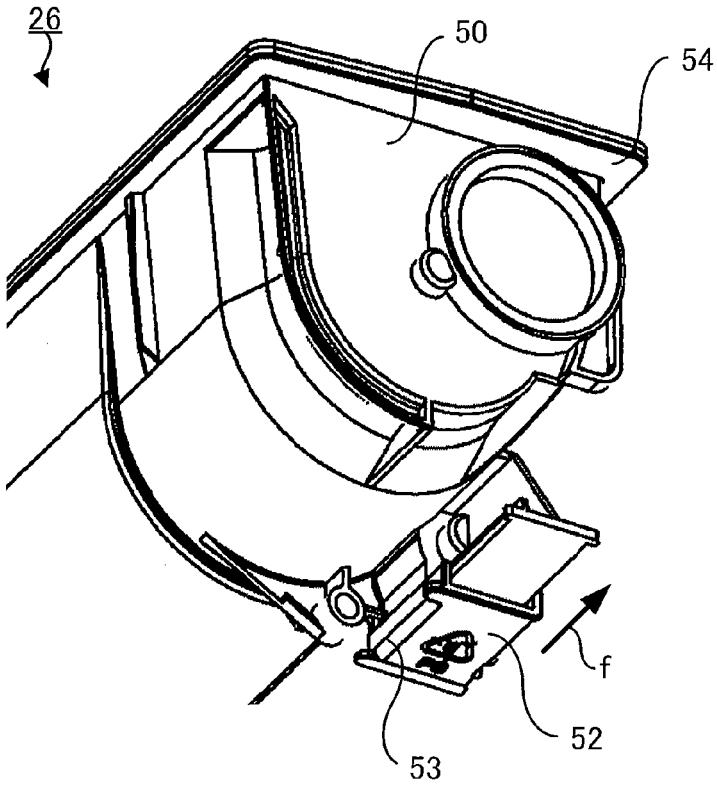
FIG. 2 is a perspective view in which a shutter of a toner cartridge according to the embodiment is seen from under when being closed.
Figure 3:
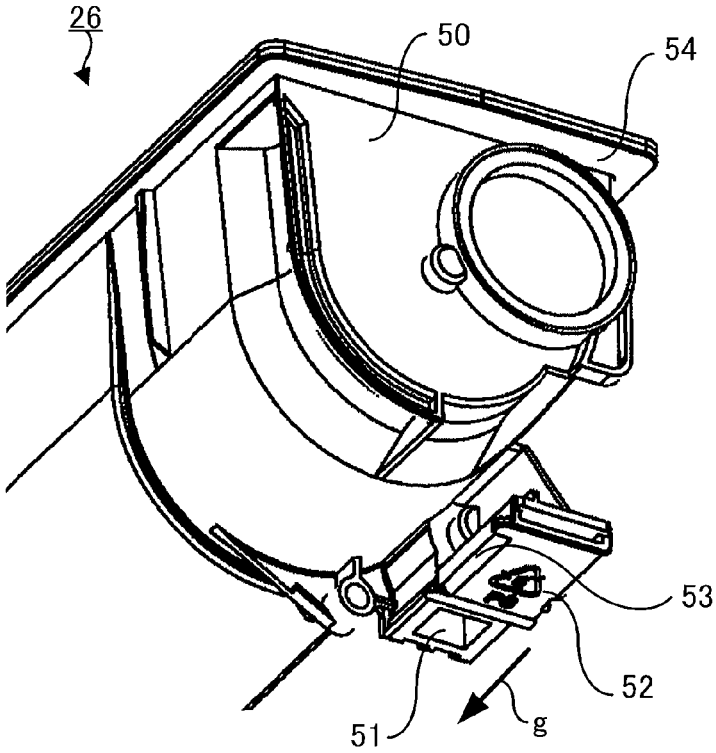
FIG. 3 is a perspective view in which the shutter of the toner cartridge according to the first embodiment is seen from under when being opened.

The toner cartridges 26Y, 26M, 26C, and 26K have the same structure as each other, even though the toners received therein differ from each other. Subsequently, the structure of the toner cartridges 26Y, 26M, 26C, and 26K will be described using common reference numerals with reference to FIGS. 2 and 3. FIG. 2 shows a closed state of a shutter 52 to be described later, and FIG. 3 shows an open state of the shutter 52, respectively. As shown in these figures, a toner cartridge 26 includes a toner storage unit 50 which stores the toner, and a toner discharge port 51 which is provided on the front side by communicating with the toner storage unit 50, and discharges the toner. In addition, the toner cartridge 26 includes the shutter 52 which opens or closes the toner discharge port 51, and a shutter support unit 53 which slidably retains the shutter 52. The shutter 52 opens the toner discharge port 51 by sliding in the arrow f direction when being hooked by a hook 63 (engagement unit) to be described later along with an operation of mounting the toner cartridge 26 to the cartridge box 2. The shutter 52 slides in the arrow g direction by a spring (not shown) which is provided in the shutter support unit 53, and closes the toner discharge port 51 when the hook 63 is released, along with the operation of dismounting the toner cartridge 26 from the cartridge box 2. The toner cartridge 26 includes a handle 54 for mounting and dismounting the toner cartridge 26 to or from the cartridge box 2.

Figure 4:
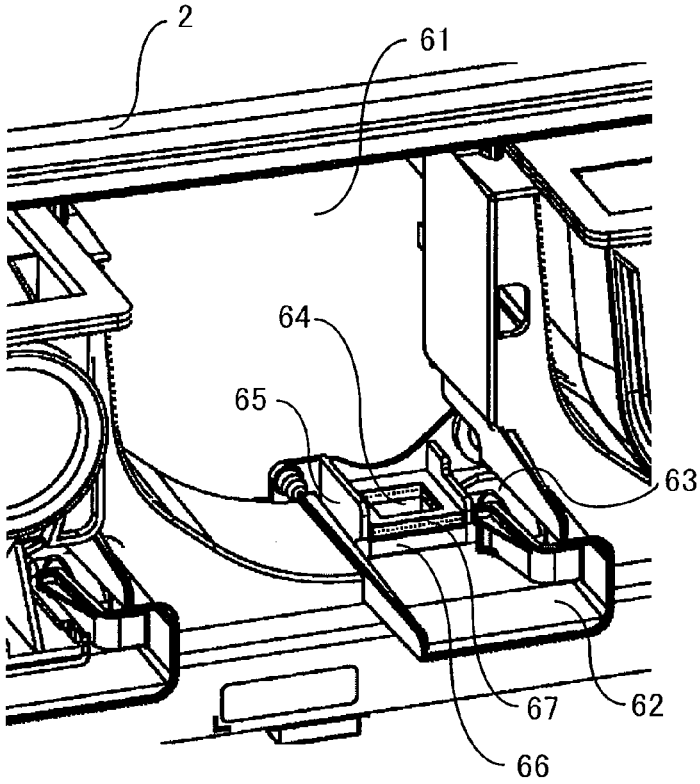
FIG. 4 is a perspective view which shows a configuration in the vicinity of a toner supply port of a cartridge box according to the first embodiment.
Figure 5:
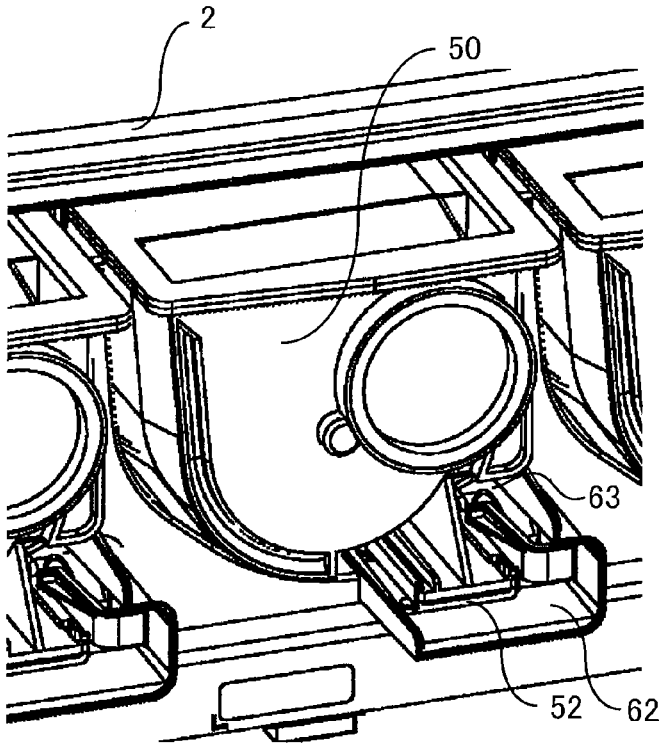
FIG. 5 is a perspective view which shows a state of the toner cartridge of the cartridge box according to the first embodiment when being mounted.

As shown in FIG. 4, the cartridge box 2 includes a toner supply port frame 65 in which a toner supply port 64 to which the toner is supplied is formed on the bottom 62 of a cartridge storage unit 61. The hook 63 as an engagement unit which fixes the shutter 52 by being engaged with a part of the shutter 52 of the toner cartridge 26 is included on the right side of the cartridge storage unit 61. When the hook 63 locks the shutter 52, the shutter 52 of the toner cartridge 26 is openable. In addition, since it is necessary to close the shutter 52 by reliably locking the hook 63 to the shutter 52 when mounting the toner cartridge 26, a margin is provided between the hooking position of the hook 63 and the position where the toner cartridge 26 stops so that the shutter 52 slightly passes through the hooking position of the hook 63, and then stops.

In addition, an elastic member 66 which is sponge formed of polyurethane, natural rubber, or the like, is fixed, and an opening member 67 is fixed on the top face of the elastic member 66 in the vicinity of the toner supply port 64 of the toner supply port frame 65. The opening member 67 stops the advance of the shutter 52 which moves along with the main body of the toner cartridge 26 by being in contact with the shutter 52 when mounting the toner cartridge 26 at the abutting position, and opens the shutter 52. A follow-up mechanism which causes the elastic member 66, opening member 67, and the toner supply port frame 65 to slide on the bottom 62 of the cartridge storage unit 61 corresponding to the gap of the above described margin in a body. The details of the follow-up mechanism will be described later.

When a user mounts the toner cartridge 26 in the cartridge box 2, the shutter 52 is hooked by the hook 63, comes into contact with the opening member 67, and slides in the opening direction of the toner discharge port 51. When the toner discharge port 51 of the toner cartridge 26 is open, the toner discharge port 51 and the toner supply port 64 communicate with each other. In addition, the toner in the cartridge box 2 passes through the toner supply port 64, and is supplied to the developing devices 20Y, 20M, 20C, and 20K from the toner discharge port 51.

In contrast to this, when a user dismounts the toner cartridge 26 from the cartridge box 2, the shutter 52 slides and closes the toner discharge port 51. Accordingly, when dismounting the toner cartridge 26 from the cartridge box 2, the toner is prevented from spilling at the periphery of the toner discharge port 51.

Figure 6:
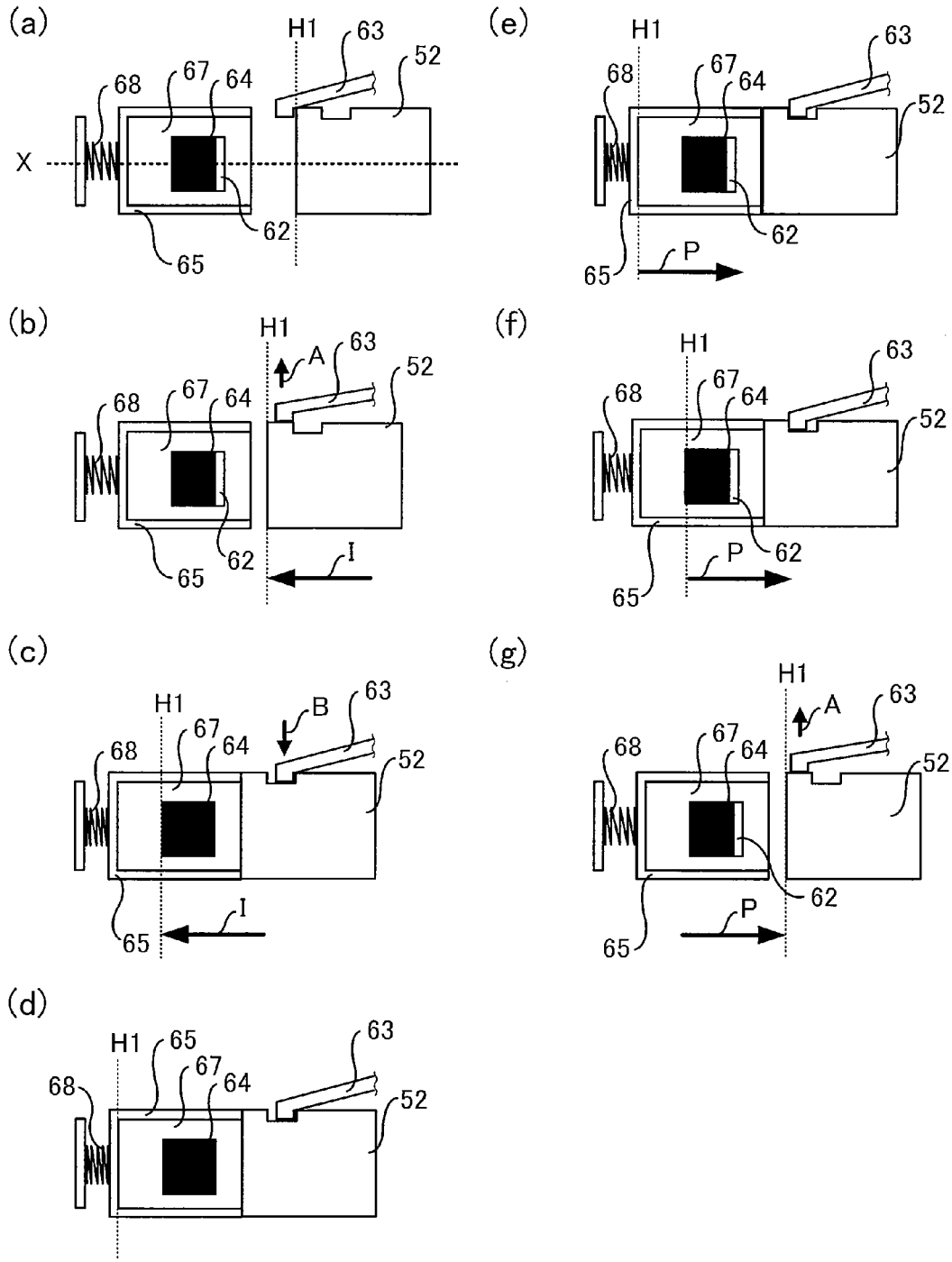
FIGS. 6(*a*)-6(*g*) are top view which illustrate continuous actions of mounting and dismounting the toner cartridge according to the first embodiment.
Figure 7:
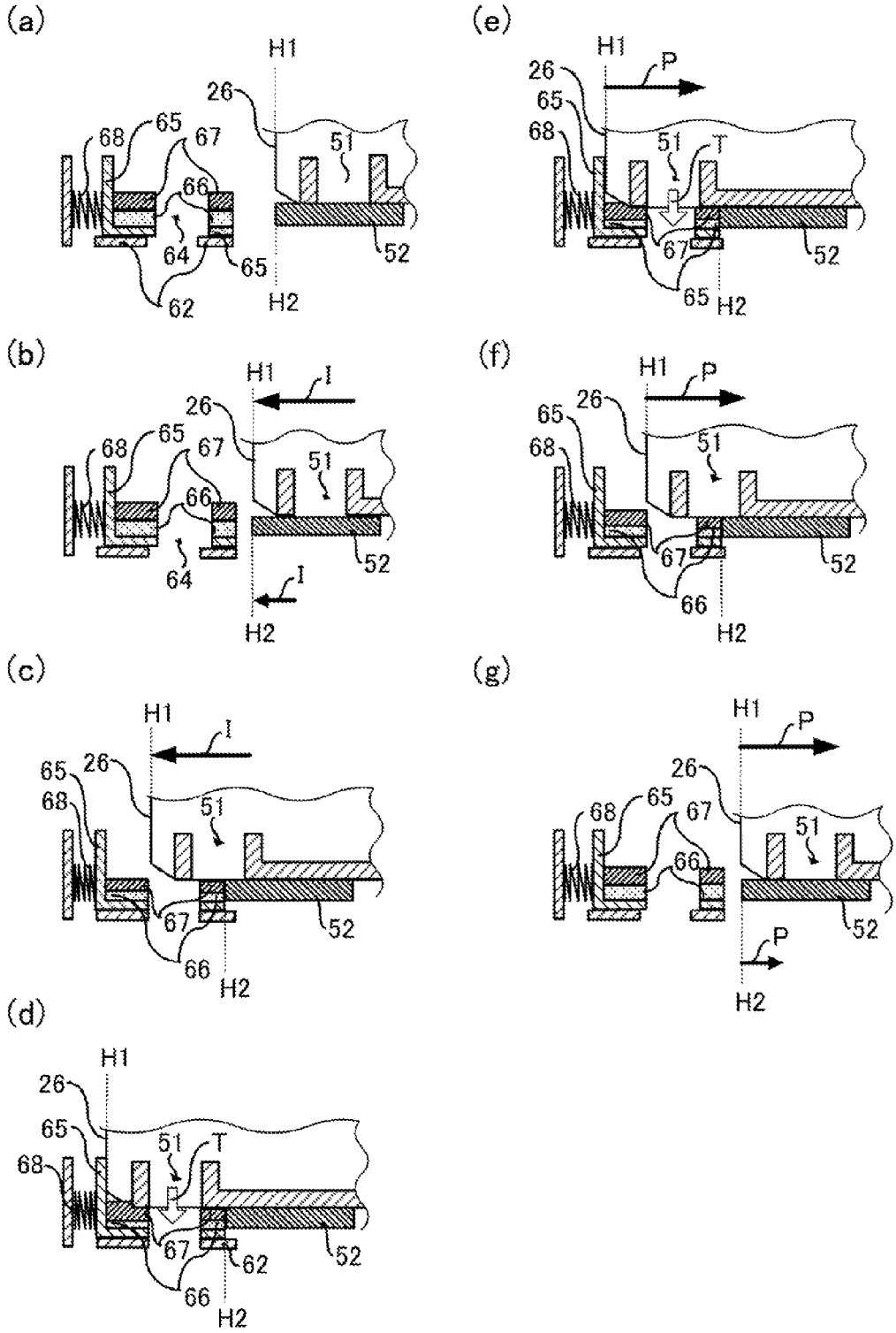
FIGS. 7(*a*)-7(*g*) are cross-sectional views which illustrate the continuous actions of mounting and dismounting the toner cartridge according to the first embodiment.

Hereinafter, the internal structure of the cartridge box 2 and the toner cartridge 26 of the MFP 10, and the operations when mounting and dismounting the toner cartridge 26 will be described with reference to FIGS. 6(*a*) to 6(*g*) and 79(*a*) to 7(*g*). FIGS. 6(*a*) and 6(*g*) are top views describing the continuous operations when mounting and dismounting the toner cartridge 26. FIGS. 7(*a*) to 7(*g*) are cross-sectional views which describe the continuous operations when mounting and dismounting the toner cartridge 26 when taken along the dotted line X in FIGS. 6(*a*) to 6(*g*). FIGS. 6(*a*) to 6(*g*) are respectively synchronized with FIGS. 7(*a*) to 7(*g*), and the reference numerals attached to the dotted line and arrow respectively denote common positions and movement directions. In addition, in FIGS. 6(*a*) to 6(*g*), the main body of the toner cartridge 26 is omitted in the figure, and the position of the front part. H1 is denoted by the dotted line, in order to describe the relationship between the shutter 52 and the hook 63.

FIGS. 6(*a*) and 7(*a*) show a state where the toner cartridge 26 is inserted to the cartridge box 2. The toner discharge port 51 is completely closed by the shutter 52. A separate elastic member 68 is closely arranged at the outer side of the toner supply port frame 65. Here, a coil spring is used as the elastic member 68, however, other springs such as a flat spring may be used. Similarly to the elastic member 66 which is fixed to the toner supply port frame 65, the elastic member 66 may also be substituted by sponge which is formed of polyurethane, silicon, rubber, or the like, as long as the member is an elastic member.

Subsequently, when the toner cartridge 26 is inserted in the arrow I direction, that is, when further moving in the cartridge mounting direction, it enters the state in FIGS. 6(*b*) and 7(*b*). As shown in FIGS. 6(*b*) and 7 (*b*), the hook 63 passes through the front part H2 of the shutter 52 by being bent in the arrow A direction.

Subsequently, when the toner cartridge 26 is further moved in the arrow I direction, and enters the state of FIGS. 6(*c*) and 7(*c*). At this time, the hook 63 is locked by moving in the arrow B direction at the same time as the shutter 52 comes into contact with the opening member 67 of the toner supply port frame 65, and the shutter 52 is open. The elastic member 66 of the toner supply port frame 65 is compressed when the opening member 67 comes into contact with the lower surface of the toner cartridge 26, and causes the opening member 67 to be in close contact with the toner cartridge 26 using the elastic force. The shutter 52 comes into contact with the opening member 67 at the front part H2. For this reason, the shutter 52 opens further when the toner cartridge 26 advances in the arrow I direction, and the toner discharge port 51 and the toner supply port 64 start to communicate with each other.

In addition, as shown in FIGS. 6(*c*) and 7(*c*), the toner supply port frame 65 slides in the arrow I direction along on the bottom 62 of the cartridge storage unit 61 along with the opening member 67 and the elastic member 66, and compresses the elastic member 68 which is provided at the outer side of the toner supply port frame 65. The elastic member 68 is subject to elastic deformation slowly, according to the insertion of the toner cartridge 26.

Subsequently, when the toner cartridge 26 is further moved in the arrow I direction, the front part H1 of the toner cartridge 26 reaches the inner wall of the toner supply port frame 65, and stops, and it becomes the state shown in FIGS. 6(*d*) and 7(*d*). At this time, the toner discharge port 51 and the toner supply port 64 completely communicate with each other, and toner T flows in from the toner discharge port 51 to the toner supply port 64. The elastic member 68 is compressed when the toner cartridge 26 is mounted.

Subsequently, when the toner cartridge 26 is pulled in the arrow P direction, that is, is moved in the cartridge dismounting direction, it becomes the state shown in FIGS. 6(*e*) and 7(*e*). At this time, since the elastic member 68 is elastically deformed in the arrow P direction, the toner supply port frame 65 slides on the bottom 62. As a result, the opening member 67 is moved following the front part H2 of the shutter 52 by being in close contact therewith. In addition, the width of sliding, for the toner supply port frame 65 is preferably designed to a dimension which has a tolerance of approximately a few millimeters in addition to the gap of the above described margin.

Subsequently, when the toner cartridge 26 is further moved in the arrow P direction, it becomes the state shown in FIGS. 6(*f*) and 7(*f*). At this time, the toner supply port frame 65 is still sliding on the bottom 62, and the opening member 67 is moved following the front part H2 of the shutter 52 by being in close contact therewith.

In addition, when the toner cartridge 26 is further moved in the arrow P direction, it becomes the state shown in FIGS. 6(*g*) and 7(*g*). When a user tries to dismount the toner cartridge 26 exceeding the movable range of the shutter 52, the hook 63 is bent in the arrow A direction, the engagement due to the hook 63 is released, and the toner cartridge 26 is dismounted in a state where the shutter 52 is completely closed. The elastic member 68 causes the opening member 67 to move following the shutter 52 by being in close contact therewith until at least the engagement of the hook 63 and the shutter 52 is released.

In this manner, according to the embodiment, the toner supply port frame 65 is able to slide in the dismounting direction of the toner cartridge 26 by the width to which an appropriate tolerance is added to the gap of the above described margin. For this reason, the opening member 67 moves following the shutter 52 by being in close contact therewith, at least before the hook 63 is released, and the shutter 52 is about to start closing by the spring (not shown). As a result, the structure becomes one in which the gap generated between members of the shutter 52 and the toner supply port frame 65 when dismounting the toner cartridge 26, which was the case in the apparatus in the related art, is filled, and it is possible to prevent the toner from spilling, and no longer pollute the surroundings.

<Second Embodiment>

Subsequently, a second embodiment will be described with reference to FIGS. 8(*a*) to 8(*g*) and FIGS. 9(*a*) to 9(*g*). The second embodiment has a different structure for executing a follow-up movement from the first embodiment. Specifically, there are three different points as follows. First, an elastic member 68 is not provided at the outer side of a toner supply port frame 65. Secondly, the toner supply port frame 65 is fixed onto the bottom 62 of the toner storage unit 61, and does not slide. Thirdly, an elastic member 66 is fixed to a position which is separated from the inner side wall surface of the toner supply port frame 65 by a predetermined distance. That is, the elastic member 66 causes an opening member 67 to move following a shutter 52 by being elastically deformed when dismounting a toner cartridge 26. Since the others are the same as those in the first embodiment, the same constituent elements as those described in the first embodiment will be given with the same reference numerals, and descriptions thereof will be omitted.

Hereinafter, the internal structure of a cartridge box 2 and the toner cartridge 26 of the MFP 10, and the operations when mounting and dismounting the toner cartridge 26 will be described. FIGS. 8(*a*) to 8(*g*) are top views describing the continuous operations when mounting and dismounting the toner cartridge 26. FIGS, 9(*a*) to 9(*g*) are cross-sectional views which describe the continuous operations when mounting and dismounting the toner cartridge 26 when taken along the dotted line X in FIGS. 8(*a*) to 8(*g*) FIGS. 8(*a*) to 8(*g*), and FIGS. 9(*a*) to 9(*g*) are synchronized, respectively, and the reference numerals attached to the dotted line and arrow are denoting the common position and movement direction, respectively.

Figure 8:
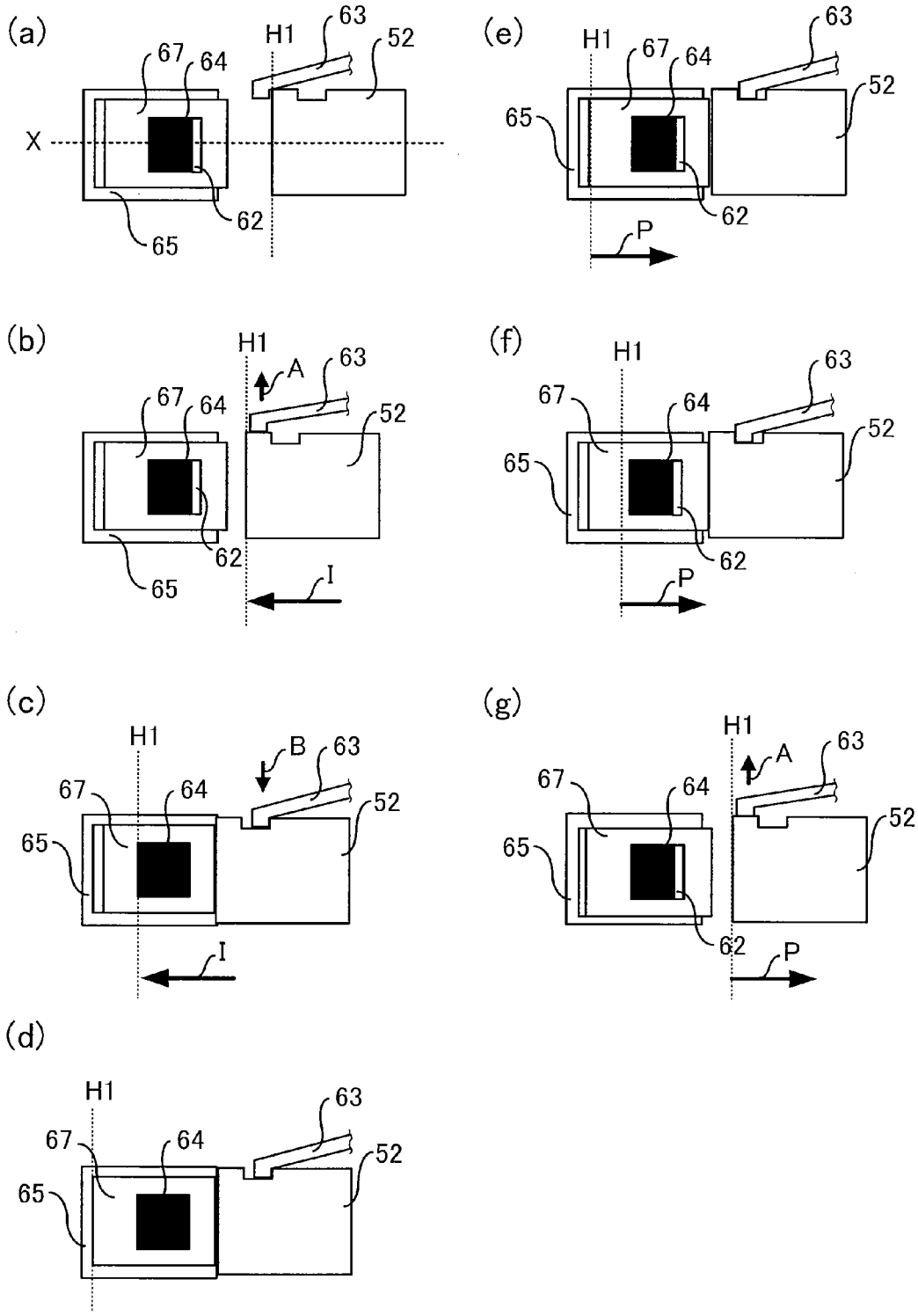
FIGS. 8(*a*)-8(*g*) are top views which illustrate continuous actions of mounting and dismounting the toner cartridge according to a second embodiment.
Figure 9:
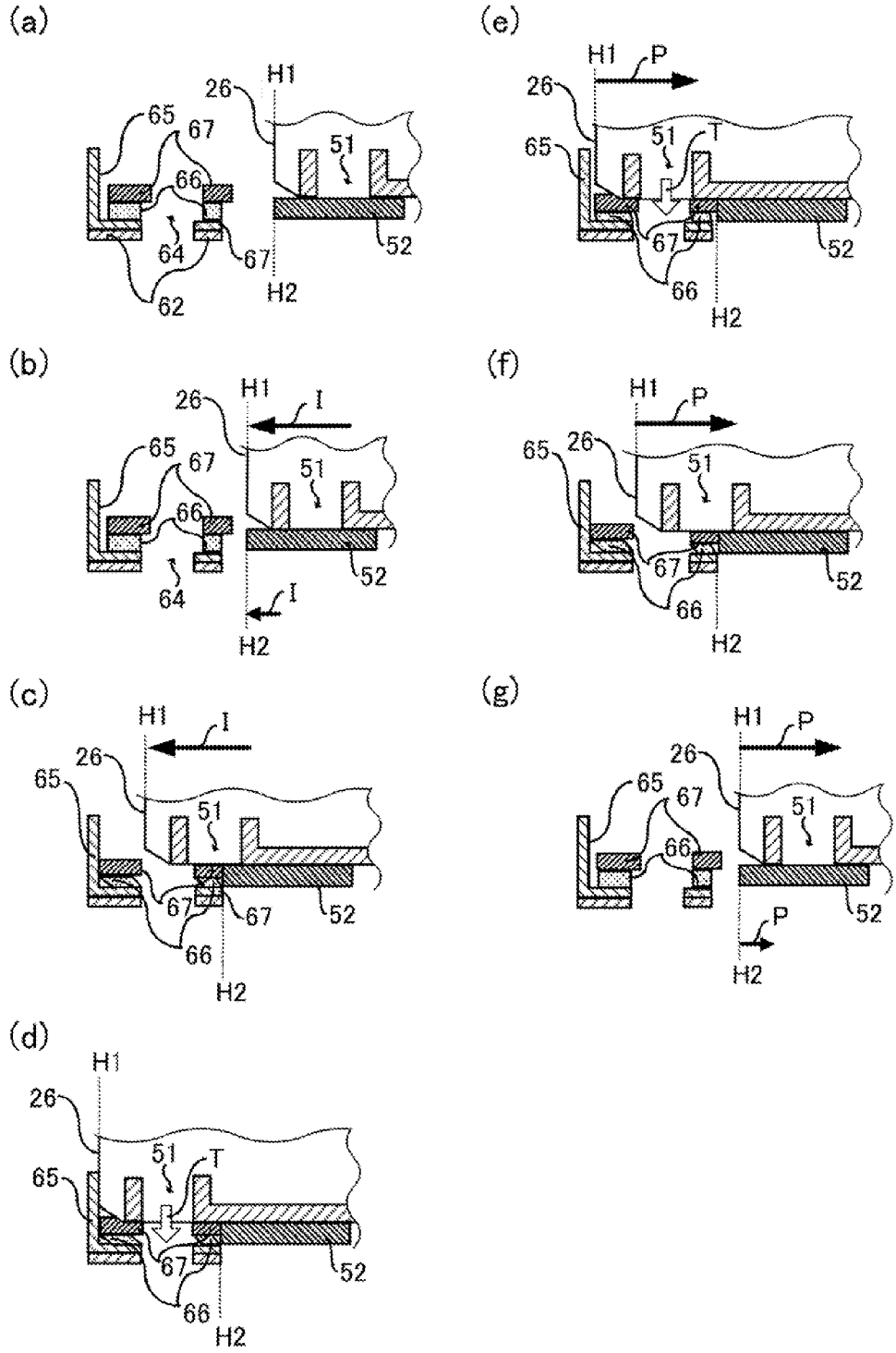
FIGS. 9(*a*)-9(*g*) are cross-sectional views which illustrate the continuous actions of mounting and dismounting the toner cartridge according to the second embodiment.

FIGS. 8(*a*) and 9(*a*) show a state where the toner cartridge 26 is being inserted to a cartridge box 2. In this initial state, a toner discharge port 51 is completely closed by the shutter 52.

Subsequently, the toner cartridge 26 is inserted in the arrow I direction, that is, moves further in the cartridge mounting direction, and reaches the state shown in FIGS. 8(*b*) and 9(*b*). As shown in FIGS. 8(*b*) and 9(*b*), a hook 63 is bent in the arrow A direction, and passes through the front part H2 of the shutter 52.

Subsequently, when the toner cartridge 26 is further moved in the arrow I direction, and enters the state shown in FIGS. 8(*c*) and 9(*c*). At this time, the hook 63 is moved in the arrow B direction, and locked at approximately the same time when the shutter 52 comes into contact with an opening member 67 of the toner supply port frame 65, accordingly, the shutter 52 is openable. An elastic member 66 which is fixed onto the toner supply port frame 65 is compressed in the lower direction when the opening member 67 comes into contact with the lower surface of the toner cartridge 26. In addition, since the elastic member 66 is separated from the side wall surface of the toner supply port frame 65 in the arrow I direction, the upper surface side which is fixed to the opening member 67 slides in the arrow I direction. The elastic member 66 causes the opening member 67 to be in close contact with the lower surface of the toner cartridge 26 using the elastic force. The shutter 52 comes into contact with the opening member 67 in the front part H2, For this reason, the shutter 52 is further opened when the toner cartridge 26 advances in the arrow I direction, accordingly, the toner discharge port 51 and the toner supply port 64 start to communicate with each other.

Subsequently, when the toner cartridge 26 further moves in the arrow I direction, the front part H1 of the toner cartridge 26 reaches the inner wall of the toner supply port frame 65, and enters the state shown in FIGS, 8(*d*) and 9(*d*). At this time, the toner discharge port 51 and the toner supply port 64 completely communicate with each other, and toner T flows into the toner supply port 64 from the toner discharge port 51. The elastic member 66 is compressed when the toner cartridge 26 is mounted.

Subsequently, the toner cartridge 26 is pulled in the arrow P direction, that is, when the toner cartridge 26 is moved in the dismounting direction, and enters the state shown in FIGS. 8(*e*) and 9(*e*). At this time, the elastic member 66 is elastically deformed in the dismounting direction, accordingly, the opening member 67 is moved following the shutter 52 by being in close contact with the front part H2 of the shutter 52. In addition, the width of follow-Lip movement of the opening member 67 with respect to the shutter 52 by the elastic deformation of the elastic member 66 is preferably designed to a dimension which has a tolerance of approximately a few millimeters in addition to the gap of the above described margin.

Subsequently, when the toner cartridge 26 further moves in the arrow P direction, and enters the state shown in FIGS. 8(*f*) and 9(*f*). At this time, the elastic member 66 is elastically deformed on the bottom 62, and the opening member 67 moves following the shutter 52 by being in close contact with the front part H2 of the shutter 52.

In addition, when the toner cartridge 26 further moves in the arrow P direction, and enters the state shown in FIGS. 8(*g*) and 9(*g*). When a user tries to dismount the toner cartridge 26 exceeding the movable range of the shutter 52, the hook 63 is bent in the arrow A direction, and the toner cartridge 26 is dismounted in a state where the shutter 52 is completely closed.

According to the embodiment, it is possible to obtain the same effect as that of the first embodiment by using the elastic member 66 which is attached onto the toner supply port frame 65 for making the toner discharge port 51 and the periphery of the toner supply port 64 come in close contact with each other. In this manner, it is possible to make a simpler structure than that in the first embodiment by reducing the number of parts.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. An image forming apparatus to which a toner cartridge is mounted comprising:

a toner cartridge which includes a toner discharge port configured to discharge stored toner, and a shutter configured to open and dose the toner discharge port;

a toner supply unit which includes an engagement unit configured to engage with the shutter of the toner cartridge, a toner supply port configured to communicate with the toner discharge port and to receive the toner supplied from the toner discharge port when the shutter is open, an opening member configured to open the shutter and an elastic member configured to cause the opening member to move following the shutter by being in contact with the shutter until at least the engagement between the engagement unit and shutter is released during dismounting of the toner cartridge from the image forming apparatus; and a developing device which develops an electrostatic latent image which is formed on an image carrier using the toner which is supplied to the toner supply unit.

2. The apparatus according to claim 1, wherein the elastic member is arranged in the vicinity of the outside of a frame of the toner supply port, elastically deforms in a direction opposite to the direction at the time of mounting of the toner cartridge, when dismounting the toner cartridge, and pushes out the opening member in the dismounting direction.

3. The apparatus according to claim 2, wherein the elastic member is a coil spring, or a flat spring.

4. The apparatus according to claim 2, wherein the elastic member is sponge which is formed of polyurethane.

5. The apparatus according to claim 2, wherein the elastic member is sponge which is formed of silicon, or rubber.

6. The apparatus according to claim 1, wherein, in the elastic member, a lower surface side is fixed to the periphery of the toner supply port, and an upper surface side is fixed to the bottom of the opening member, while a side surface side is separated from a frame of the toner supply port, and the elastic member elastically deforms in a direction opposite to a direction at the time of mounting of the toner cartridge, when dismounting the toner cartridge, and pushes out the opening member in the dismounting direction.

7. The apparatus according to claim 6, wherein the elastic member is sponge which is formed of polyurethane.

8. The apparatus according to claim 6, wherein the elastic member is sponge which is formed of silicon, or rubber.

9. A toner supply mechanism comprising:

a toner cartridge which includes a toner discharge port configured to discharge stored toner, and a shutter configured to open and close the toner discharge port; and a toner supply unit which includes an engagement unit configured to engage with the shutter of the toner cartridge, a toner supply port configured to communicate with the toner discharge port and to receive the toner supplied from the toner discharge port when the shutter is open, an opening member configured to open the shutter and an elastic member configured to cause the opening member to move following the shutter by being in contact with the shutter until at least the engagement between the engagement unit and the shutter is released during dismounting of the toner cartridge from an image forming apparatus.

10. The mechanism according to claim 9, wherein the elastic member is arranged in the vicinity of the outside of a frame of the toner supply port, elastically deforms in a direction opposite to a direction at the time of mounting of the toner cartridge, when dismounting the toner cartridge, and pushes out the opening member in the dismounting direction.

11. The mechanism according to claim 10, wherein the elastic member is a coil spring, or a flat spring.

12. The mechanism according to claim 10, wherein the elastic member is sponge which is formed of polyurethane.

13. The mechanism according to claim 10, wherein the elastic member is sponge which is formed of silicon, or rubber.

14. The mechanism according to claim 9, wherein, in the elastic member, a lower surface side is fixed to the periphery of the toner supply port, and an upper surface side is fixed to the bottom of the opening member, while a side surface side is separated from a frame of the toner supply port, and the elastic member elastically deforms in a direction opposite to a direction at the time of mounting of the toner cartridge, when dismounting the toner cartridge, and pushes out the opening member in the dismounting direction.

15. The mechanism according to claim 14, wherein the elastic member is sponge which is formed of polyurethane.

16. The mechanism according to claim 14, wherein the elastic member is sponge which is formed of silicon or rubber.

17. A method of mounting and dismounting a toner cartridge for an image forming apparatus which has a toner supply port, comprising:

mounting a toner cartridge having a shutter which opens and closes a toner discharge port which discharges toner stored therein when the toner cartridge is mounted to the image forming apparatus;

urging an elastic member provided at the periphery of a toner supply port to be deformed when the toner cartridge is mounted;

engaging the shutter with an engagement unit when the toner cartridge is mounted;

opening the shutter by causing the shutter to come into contact with an opening member and causing the toner supply port to communicate with the toner discharge port; and causing the opening member to move following the shutter until at least the engagement between the engagement unit and the shutter is released, during dismounting of the toner cartridge from the image forming apparatus.

18. The method according to claim 17, wherein the elastic member is arranged in the vicinity of the outside of a frame of the toner supply port, elastically deforms by a force in an inserting direction which is added from the frame of the toner supply port when mounting of the toner cartridge, elastically deforms in a direction opposite to the direction at the time of mounting the toner cartridge, when dismounting the toner cartridge, and pushes out the frame of the toner supply port in the dismounting direction along with the opening member.

19. The method according to claim 18, wherein a coil spring, or a flat spring is used as the elastic member.

20. The method according to claim 17.

wherein, in the elastic member, a lower surface side is fixed to the periphery of the toner supply port, and an upper surface side is fixed to the bottom of the opening member, while a side surface side is separated from a frame of the toner supply port, and the elastic member elastically deforms in an inserting direction in a state of being fixed to the frame of the toner supply port when mounting the toner cartridge, elastically deforms in a direction opposite to the direction at the time of mounting of the toner cartridge, when dismounting the toner cartridge, and pushes out the opening member in the dismounting direction.

* * * * *